US005740826A

United States Patent [19]

Nevin et al.

[11] Patent Number: 5,740,826

[45] Date of Patent: Apr. 21, 1998

[54] COLLAPSIBLE STORAGE STRUCTURE

[75] Inventors: Michael Patrick Nevin, Cape Town; John M. Malan, Johannesburg, both of South Africa

[73] Assignee: Cashel International Investments Limited, Roadtown, Virgin Islands (Br.)

[21] Appl. No.: 540,578

[22] Filed: Oct. 6, 1995

[51] Int. Cl.[6] ..... E04H 15/06

[52] U.S. Cl. ..... 135/88.06; 135/88.15; 135/133

[58] Field of Search ..... 135/88.05, 88.06, 135/88.13, 88.15, 133, 134, 136, 137, 143, 148, 147

[56] References Cited

U.S. PATENT DOCUMENTS

| | | | |
|---|---|---|---|
| 2,798,501 | 7/1957 | Oliver . | |
| 2,817,344 | 12/1957 | Teeter . | |
| 3,036,583 | 5/1962 | Miller . | |
| 3,465,765 | 9/1969 | Dietz . | |
| 4,886,083 | 12/1989 | Gamache | 135/88 |
| 4,944,321 | 7/1990 | Moyet-Ortiz . | |
| 5,414,966 | 5/1995 | Montoya . | |

FOREIGN PATENT DOCUMENTS

| | | |
|---|---|---|
| 0555791 | 8/1993 | European Pat. Off. . |
| 2444139 | 7/1980 | France . |

*Primary Examiner*—Lanna Mai
*Attorney, Agent, or Firm*—Ladas & Parry

[57] ABSTRACT

A collapsible storage structure for the storage of an object includes a base having front and rear ends and on or over which the object can be placed. The base comprises a pair of longitudinally extending, spaced, parallel rails. A plurality of inverted, substantially U-shaped canopy supports span the base from one rail to the other and are mounted so as to be foldable with respect to the base. A canopy is carried on the canopy supports, the arrangement being such that, when the canopy supports are in a collapsed configuration, the object can be positioned with respect to the base, whereafter the canopy supports can be displaced to an configuration in which the canopy covers the object. A transport mechanism comprises a pair of carriages. One carriage is slidably arranged on each rail, the carriages carrying at least certain of the canopy supports and being displaceable between a first position in which the canopy supports are collapsed and a second position in which the canopy supports are erected.

18 Claims, 15 Drawing Sheets

COLLAPSIBLE STORAGE STRUCTURE

THE INVENTION relates to a collapsible storage structure. More particularly, the invention relates to a collapsible storage structure in the form of a carport, for use in storing a motor vehicle, although it is to be understood that the structure of the invention could also be used for the storage of other objects.

According to the invention, there is provided a collapsible storage structure for the storage of an object, the structure comprising

- a base having front and rear ends and on or over which the object can be placed, the base comprising a pair of longitudinally extending, spaced, parallel rails;
- a plurality of inverted, substantially U-shaped canopy supports spanning the base from one rail to the other and being mounted so as to be foldable with respect to the base;
- a canopy carried on the canopy supports to be supported over the object, the arrangement being such that, when the canopy supports are in a collapsed configuration, the objects can be positioned with respect to the base, whereafter the canopy supports can be displaced to an erected configuration in which the canopy covers the object; and
- a transport mechanism comprising a pair of carriages, one carriage being slidably arranged on each rail, the carriages carrying at least certain of the canopy supports and the carriages being displaceable between a first position in which the canopy supports are in their collapsed configuration and a second position in which the canopy supports are in their erected configuration.

To inhibit skewing of the carriages with respect to each other, the carriages may be interconnected via suitable flexible elements. The flexible elements may be lengths of cable which interconnect the carriages in a predetermined configuration to provide parallel motion of the carriages.

In one embodiment of the invention, the structure may further comprise a substantially U-shaped rear end member which is pivotally mounted on the carriages, the rear end member being pivotally displaceable, when the carriages are proximate the front end of the base, from a collapsed configuration in which it lies substantially horizontally at the front end of the base with a bridging part of the end member lying spaced outwardly from the front end of the base, and the rear end member further being pivotally displaceable, when the carriages are proximate the rear end of the base, from an upright configuration to an unfolded configuration in which the rear end member lies substantially horizontally with the bridging part lying spaced outwardly from the rear end of the base, there being a holding mechanism whereby the rear end member is held releasably against pivotal displacement when in its upright configuration and while it is being displaced between the front end and rear end of the base.

The holding mechanism my comprise, in respect of at least one of the carriages, a pivot arm carried by the rear end member, the arm having a receiving formation which receives a guide formation carried by said at least one of the carriages, the carriage further having a notch defined therein in which a free end of the arm is received when the rear end member is in its upright configuration.

In another embodiment of the invention, each carriage may comprise a trolley slidably mounted on its associated rail. Each trolley may be mountable on its associated rail via runners carried on the trolley.

The structure may include an operating mechanism comprising an operating lever pivotally mounted on one of the trolleys. The transport mechanism may only include one such lever but it will be appreciated that, if desired, each such trolley could have an operating lever.

Each trolley may include a carrier on which certain of the canopy supports are carried, the carrier being rotatably mounted with respect to the trolley.

In respect of that trolley having the operating lever, the operating lever may be connected to its associated carrier via a gearing arrangement. The gearing arrangement may have a gearing ratio exceeding 1:1 so that, for each degree of arc through which the operating lever is pivoted, the carrier, in turn, is rotated through an arc exceeding one degree. The applicant has found that, conveniently, a gearing ratio of between about 1:1.5 and 1:2 and, ideally, 1:1.6 provides a suitable ratio. With such a ratio, when the carriages are moved from the first position, proximate one end of the rails, to the second position, proximate an opposed end of the rails, the canopy is moved from its collapsed configuration to its fully erected configuration.

The operating lever my include a locking mechanism for locking the carriages in position at least in their second positions and, preferably, both in their first and second positions. At least that rail carrying the trolley with the operating lever may have a locking pin arranged proximate each end thereof which is engaged by a locking formation of the locking mechanism. Further, the lever, when the carriage is in its first position my be offset with respect to the vertical to one side of the vertical and, conversely, when the carriages are in their second position, the lever may be offset with respect to the vertical on an opposed side of the vertical.

The locking mechanism may include a locking arrangement which locks the lever in predetermined positions relative to the trolley. The operating lever may include a release device for releasing the operating lever from its locked positions.

The operating mechanism may include an urging means which urges the lever to a substantially vertical position. The urging means my comprise a cam formation and a biasing means for biasing the cam formation to its rest position in which the operating lever is in its vertical position.

The biasing means may be in the form of a coil spring which, due to rotation of the cam, is in tension when the lever is in any position other than the vertical.

Each trolley may include a cam lobe formation, each carrier having a follower arranged thereon which runs on the cam lobe formation to facilitate erection or collapsing of the canopy as the carriages move along the rails.

The invention is now described in more detail, by way of example, with reference to the accompanying drawings.

In the drawings:

FIG. 1 is a three dimensional view of a collapsible storage structure in accordance with the invention, shown in a fully erected configuration;

FIGS. 2*a* to 2*f* show the structure in various stages of erection, as it is progressively unfolded from its collapsed configuration (FIG. 2*a*) to its fully erected configuration (FIG. 2*f*);

Figure 1:
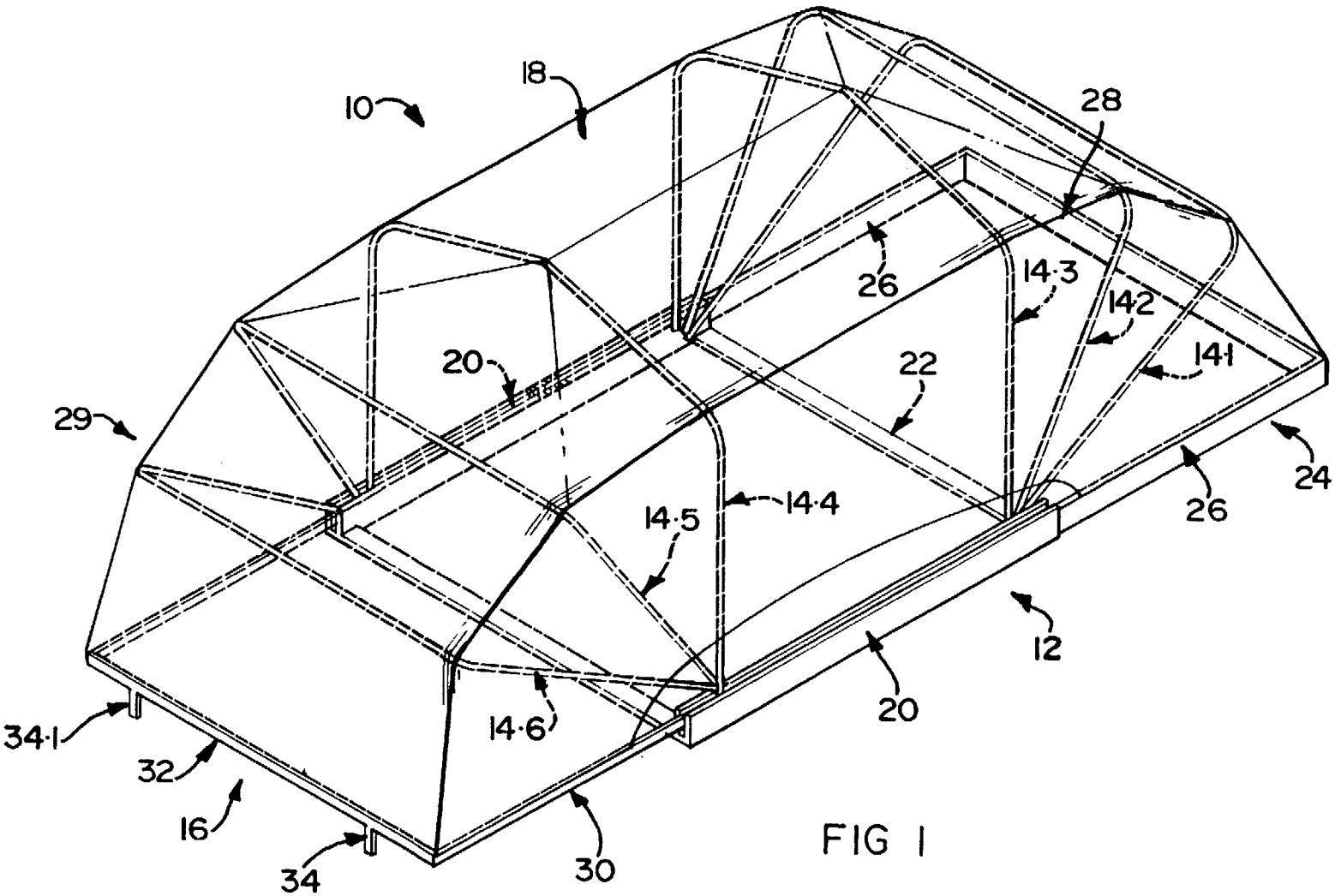

Referring firstly to FIG. 1 of the drawings, reference numeral 10 generally indicates a collapsible storage structure for storing a motor vehicle, the structure comprising a base 12, a series of inverted U-shaped canopy supports 14.1 through to 14.6 which are each mounted so as to be foldable with respect to the base, a U-shaped rear end member 16, and a canopy 18 of canvas or other suitable material supported on the canopy supports so as to form a canopy when the storage structure is in the fully erected condition as illustrated in FIG. 1.

The base 12 comprises a pair of transversely spaced, longitudinally extending track assemblies 20, and a pair of transverse tie beams 22 connecting the track assemblies together so as to form a rigid rectangular frame. The base 12 further comprises a U-shaped front end member 24 which has a pair of longitudinally extending parts 26 secured to the front ends respectively of the track assemblies 20, and a transversely extending part 28 between the ends of the parts 26. The base 12 thus consists of the track assemblies 20, the tie beams 22, the longitudinal parts 26, and the transverse part 28.

The canopy supports 14.1 to 14.3 are mounted directly on the track assemblies 20, in such a manner that each of them is pivotally displaceable about a transversely extending pivot axis. This enables them to move from a folded condition in which they lie flat against the front end member 24, to an unfolded or erected condition in which they are in the position illustrated in FIG. 1.

The canopy supports 14.4 to 14.6, and the rear end member 16 together form a foldable rear end assembly designated 29, which co-operates with the track assemblies 20 in a manner which will be described in more detail hereinafter, with reference to FIGS. 4 to 7.

The rear end member 16 comprises a pair of longitudinally extending parts 30 and a transversely extending bridging part 32 between the ends of the longitudinally extending parts. Feet 34 are provided to keep the parts 30 and 32 raised off the ground when the storage structure is in the erected configuration illustrated in FIG. 1. This facilitates lifting of the rear end member 16. It also acts as a barrier against unauthorised removal of the vehicle from the structure.

Figure 2A:
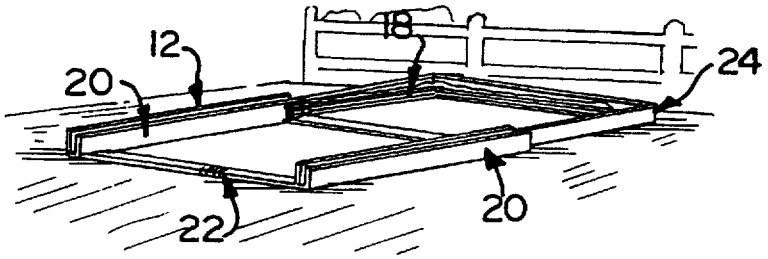
Figure 2B:
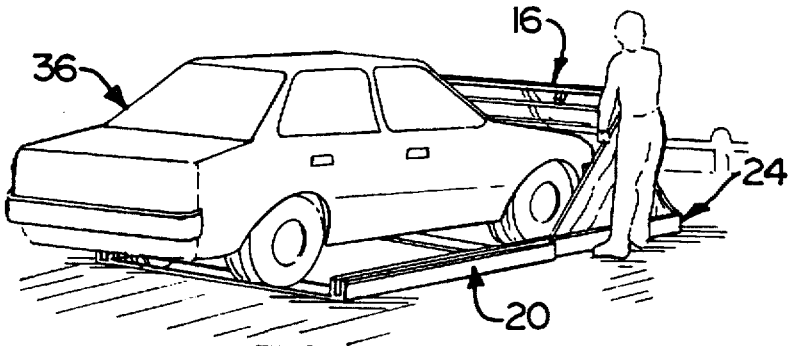

FIG. 2*a* illustrates the storage structure 10 in the fully collapsed configuration. In this configuration the canopy supports 14.1 through to 14.6 and the rear end member 16 are all at the front end of the structure, and are folded to lie flat against the front end member 24. In this configuration a motor vehicle 36 can be driven onto the storage structure, so that it stands on or over the base 12 as illustrated in FIG. 2*b*. The rear end member 16 is now lifted, causing the longitudinal parts 30 to move pivotally from a horizontal position illustrated in FIG. 2*a*, through the position illustrated in FIG. 2*b*, to the vertical position illustrated in FIG. 2*c*.

Figure 2C:
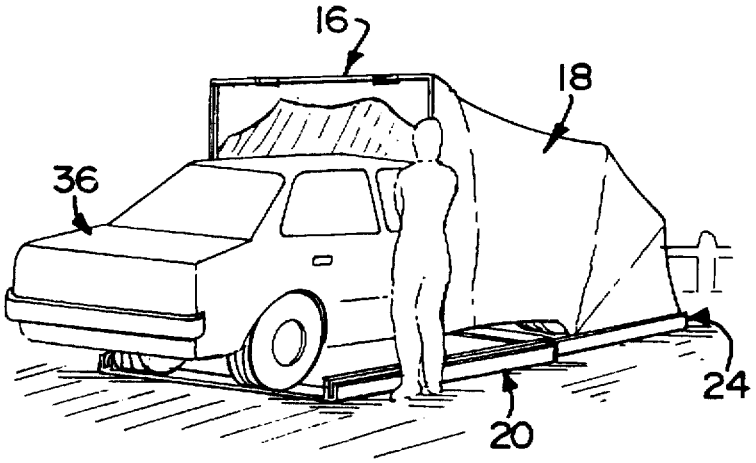
Figure 2D:
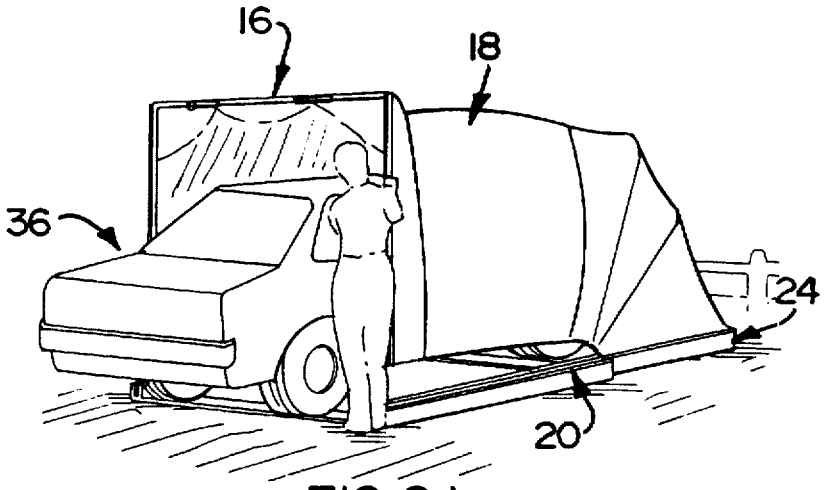
Figure 2E:
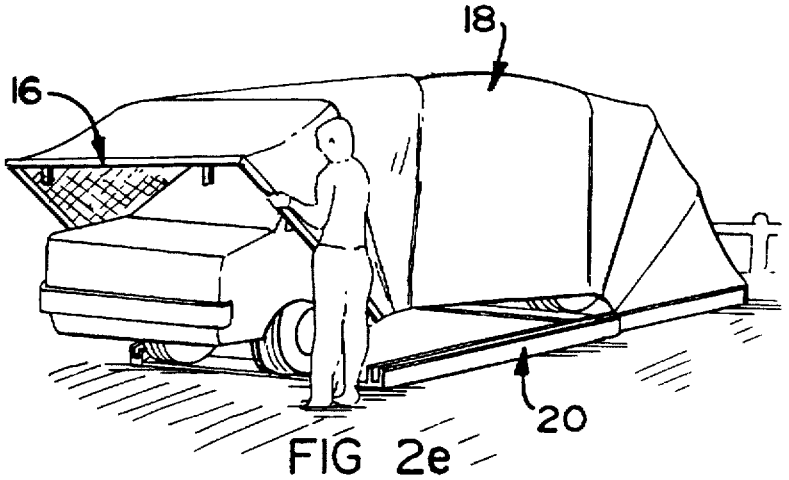
Figure 2F:
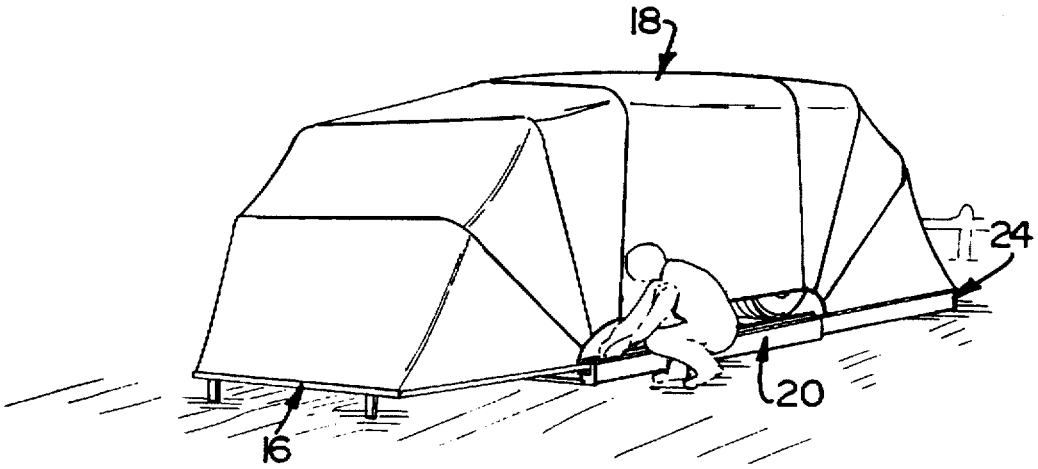
Figure 3:
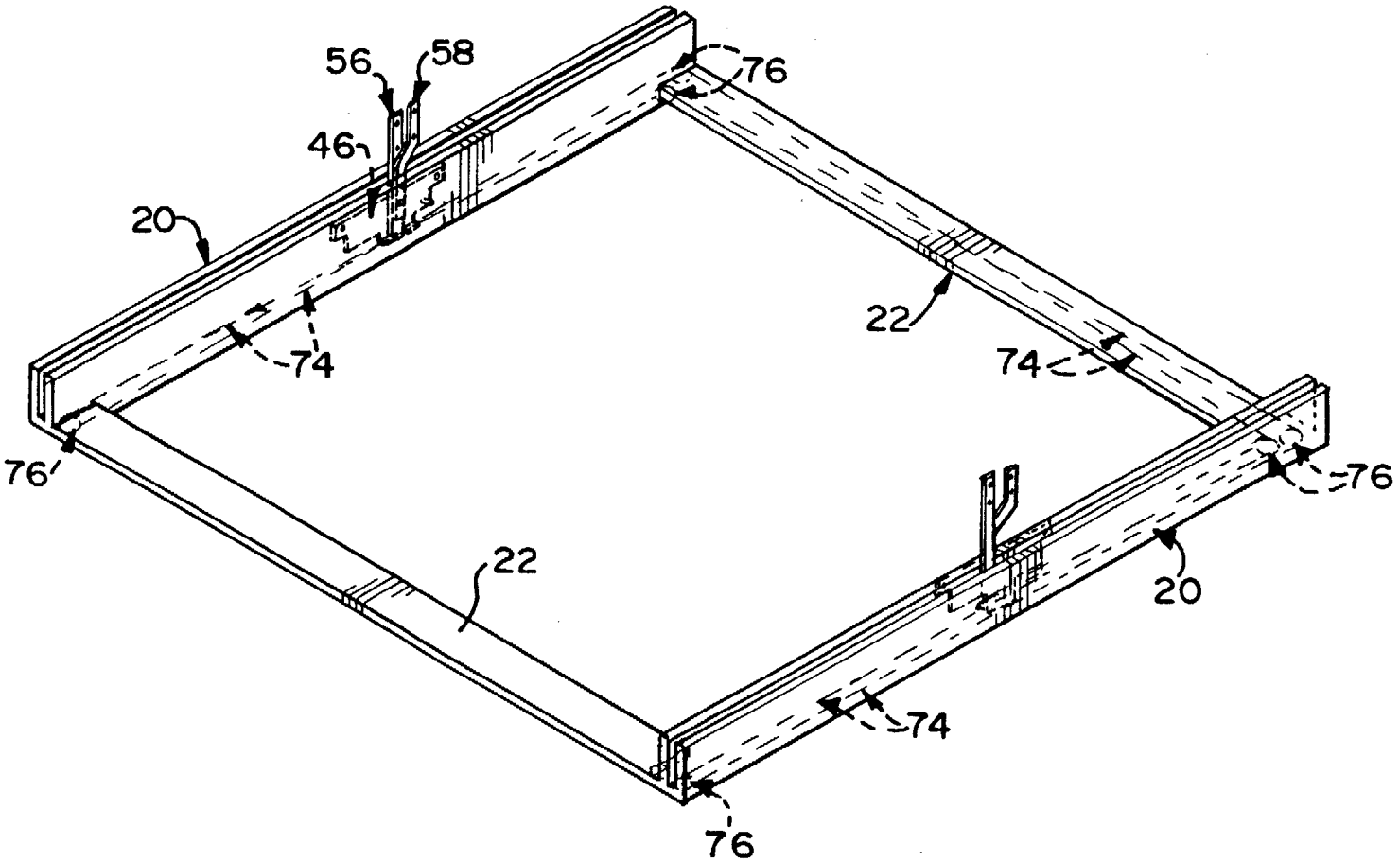
FIG. 3 is a three dimensional view of part of a base forming part of the storage structure.

Thereafter, the rear end member 16 is pulled rearwardly so that it moves from the position illustrated in FIG. 2*c* to the position illustrated in FIG. 2*d*. The rear end member 16 is then pulled back further, causing it to move pivotally from the vertical position illustrated in FIG. 2*d*, through the position illustrated in FIG. 2*e*, to the horizontal position illustrated in FIG. 2*f*.

The mechanism that guides the rear end member 16 during the movements referred to above will now be described with reference to FIGS. 3 to 7.

Each of the track assemblies 20 comprises a rail 38 which runs along the track assembly and a pair of cover plates 40 and 42 which define between them an upwardly open, longitudinally extending slot 44. The structure 10 includes a transport mechanism in the form of a pair of carriages 46. On each rail 38 there is a carriage 46 which comprises a carrier plate 48 and four runner wheels 50 which guide the carriage for movement along the rail 38. The carrier plate 48 has an inwardly projecting flange 52 at the bottom, with a notch 54 therein.

On each carrier plate 48 there is mounted a pair of pivot arms, namely a straight arm 56 and a cranked arm 58. The pivot arms 56 and 58 extend through the slot 44. The rear end member 16 is fixed to the pivot arms 56 and the canopy support 14.4 is fixed to the pivot arms 58. Furthermore, the canopy support 14.6 is pivotally mounted on the pivot arms 56 and the canopy support 14.5 is pivotally mounted on the pivot arms 58.

Figure 4:
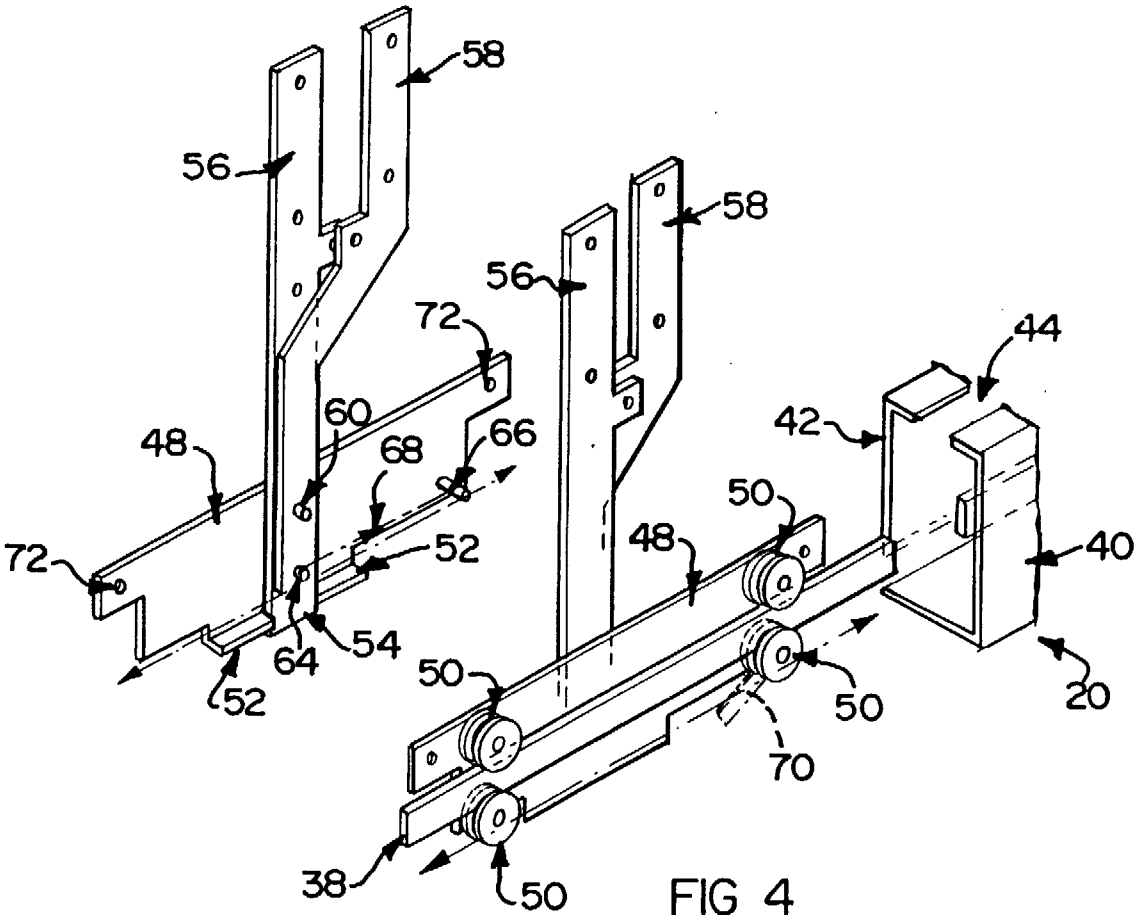
FIG. 4 is a three dimensional view of left and right hand carriages forming part of the structure.
Figure 5:
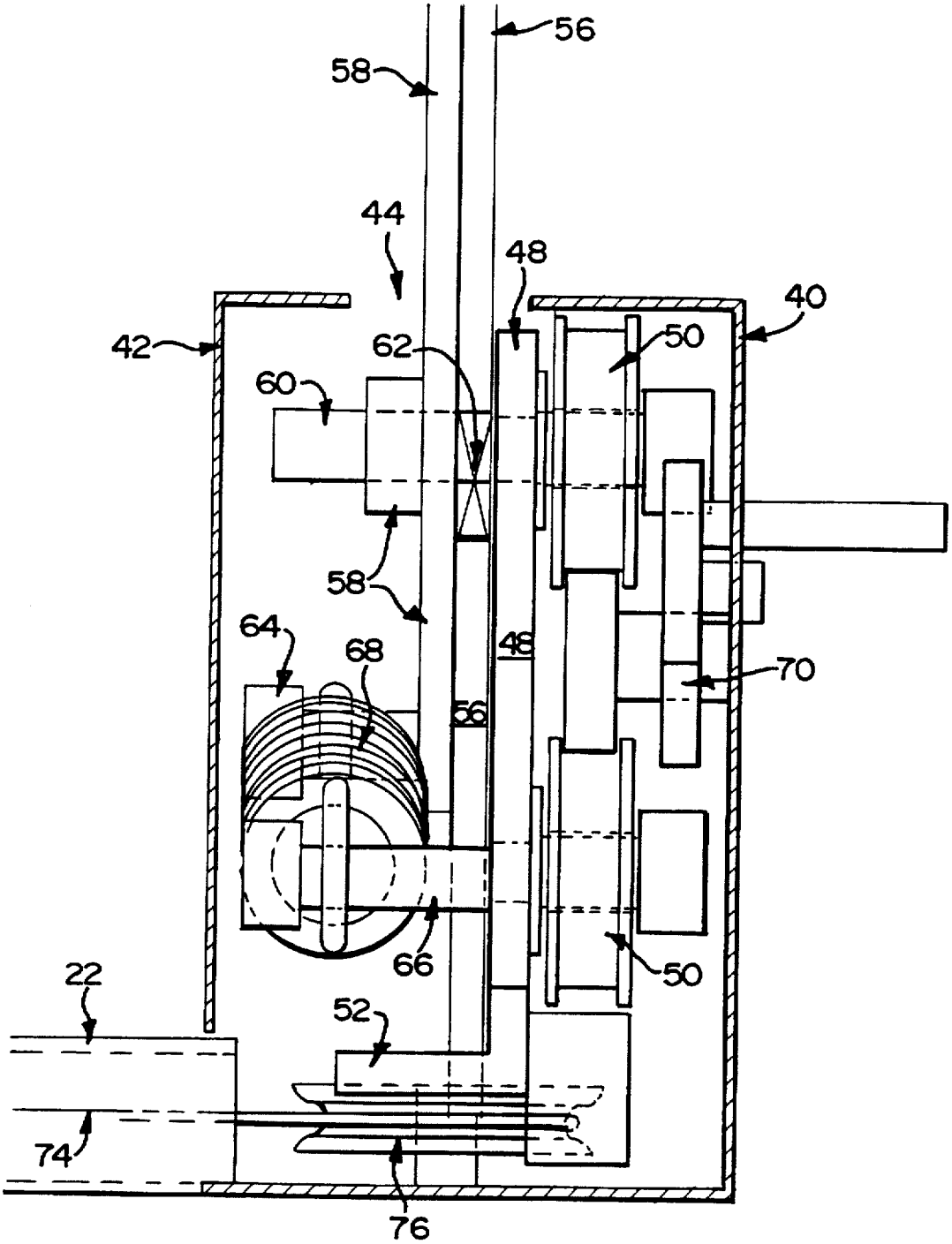
FIG. 5 is a cross section through one of the rail assemblies forming part of the storage structure, the pivotal parts thereof being in the condition shown in FIG. 4.

Both the pivot arms 56 and 58 are pivotally displaceable about a guide formation in the form of a pivot pin 60 which is fixed to the carrier plate 48. The pivot pin 60 passes through a receiving formation in the form of a slotted hole 62 in the pivot arm 56, so that the latter can slide a certain distance vertically when in the position illustrated in FIGS. 4 and 5. When in the lowermost position as illustrated in FIGS. 4 and 5, the lower end of the pivot arm 56 enters into the notch 54 so as to lock the pivot arm against pivotal displacement about the pivot pin 60. The pivot arm 58 has an anchor pin 64 at the lower end thereof, and the carrier plate 48 has an anchor pin 66 fixed thereto. There is a strong tension spring 68 between the anchor pins 64 and 66, biasing the arm 58 in the anti-clockwise direction as viewed in FIG. 4.

Finally, there is a latch 70 which is able to lock the carriage 46 against displacement along the rail when the carriage is at the front end of the rail. There is a further latch (not shown) for locking the carriage 46 against displacement along the rail when the carriage is at the rear end of the rail.

Figure 6:
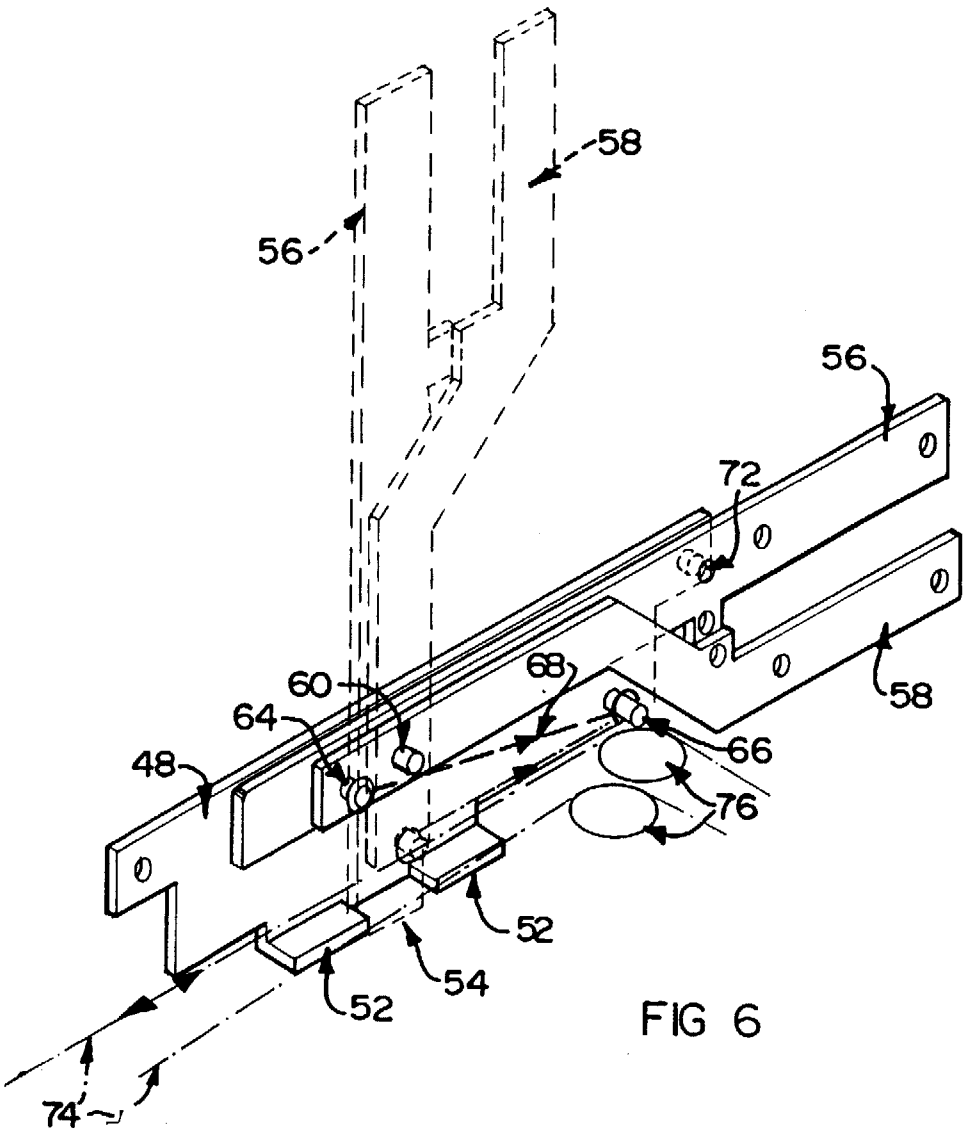
FIG. 6 shows how the pivotal parts of the left hand carriage move from the collapsed configuration to an intermediate, partially erected configuration.
Figure 7:
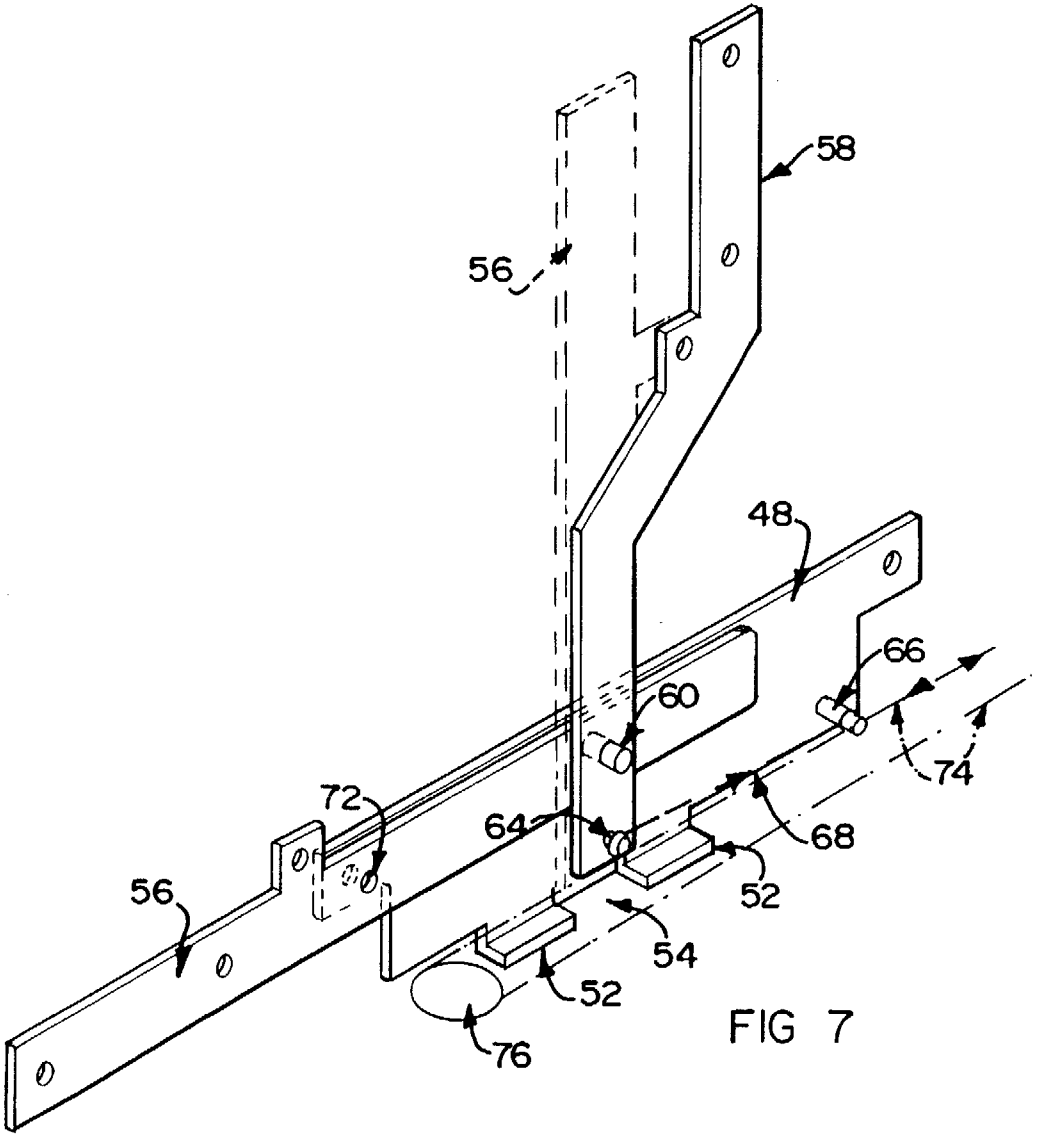
FIG. 7 shows how the pivotal parts move from the intermediate to the fully erected configuration.

When the storage structure 10 is in the fully collapsed configuration as illustrated in FIG. 2*a*, the carriages 46 are at the front end of the track assemblies 20 and locked in this position by the latch 70, and the pivot arms 56 and 58 are in the horizontal positions shown in solid lines in FIG. 6. The weight of the canopy is sufficient to keep the springs 68 in their extended condition as shown in FIG. 6.

When erecting the storage structure the rear end member 16 is lifted, causing the pivot arms 56 and 58 to move pivotally from the positions shown in solid lines in FIG. 6 to the positions indicated in dotted lines in the same drawing, in which the canopy is in an intermediate erected configuration. As the pivot arm 58 moves to the intermediate erected configuration the anti-clockwise moment exerted by the tension spring 68 on the pivot arm increases, assisting in the erection procedure. During this movement the lower end of the pivot arm 56 rides over the flange 52 and then, when the arm 56 is in the upright configuration, drops into the notch 54.

The latch 70 is now operated to release the carriage 46, and the entire rear end assembly 29 is pulled rearwardly. This causes the carriages 46 to be displaced along the rails 38 to the rear end thereof. When the carriages 46 have reached the rear end of the track assemblies 20 the further latch (not shown, but referred to above) engages with one of the carriages 46 and holds the carriages 46 in that position until the latch is released again. The end member 16 is lifted somewhat to lift the lower end of the pivot arm 56 out of the notch 54. This enables the pivot arm 56 to be displaced pivotally from the position illustrated in dotted lines in FIG. 7 to the position shown in solid lines in the same drawing. The canopy will now be in its fully erected configuration. In this configuration the canopy 18 covers the vehicle 36, the canopy being supported by the erect canopy supports 14.1 to 14.6.

The storage structure may be locked in the erected configuration by passing the staple of a padlock through openings 72 in the pivot arm 56 and the carrier plate 48 which are now in register. The same, incidentally, is possible when the pivot arm 56 is in the collapsed configuration as shown in solid lines in FIG. 6.

To move the storage structure back to its collapsed configuration the procedure described above is reversed. To make it easier to lift the end member 16 during the first part of this procedure, that part of the canopy 18 which is between the canopy support 14.4 and the end member 16 may be elasticated or sprung.

To ensure that the rear end member 16 does not skew as it moves along the track assemblies 20, the carriages 46 on opposite sides of the base 12 may be interconnected by means of a cable 74, the cable being trained on pulley wheels 76 mounted on the track assemblies 20.

Figure 12A:
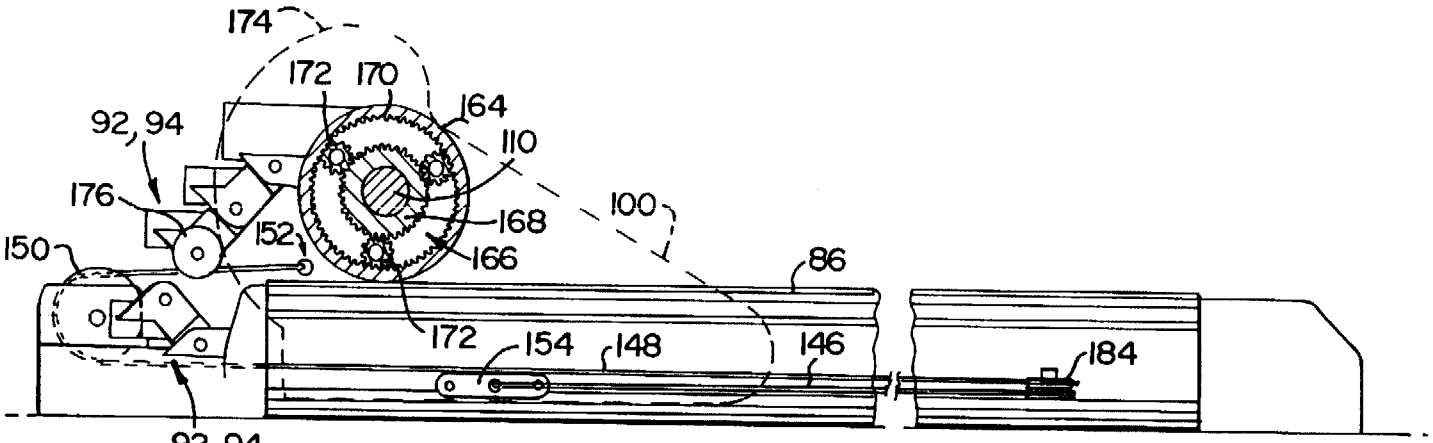
FIGS. 12A to 12C show schematic sectional side views of a carrier of the transport mechanism in various positions.
Figure 12B:
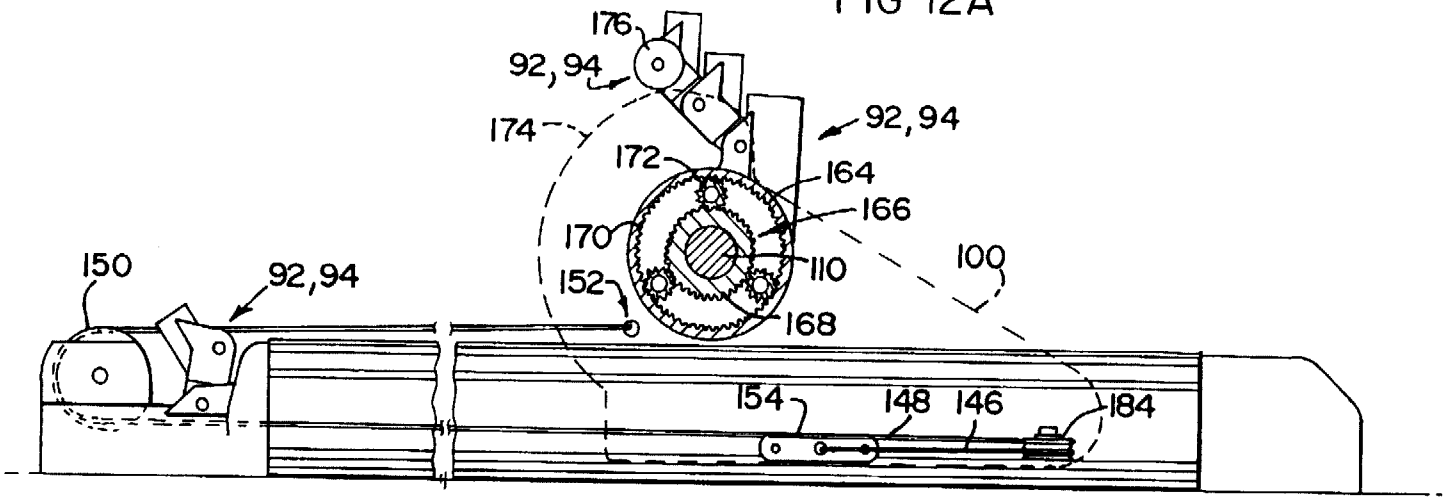
Figure 12C:
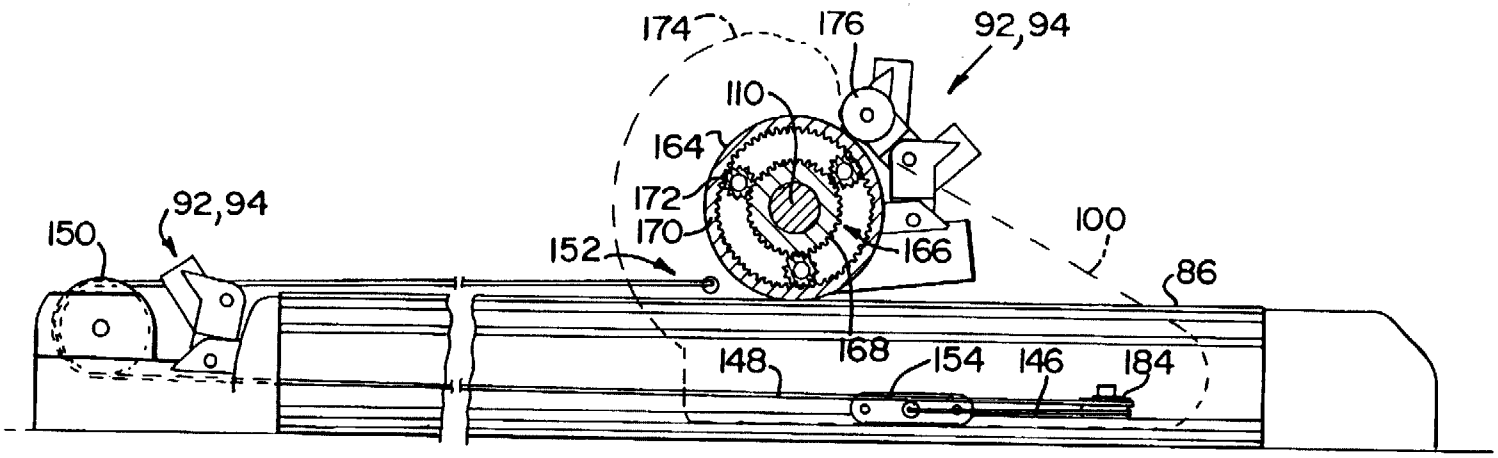
Figure 13:
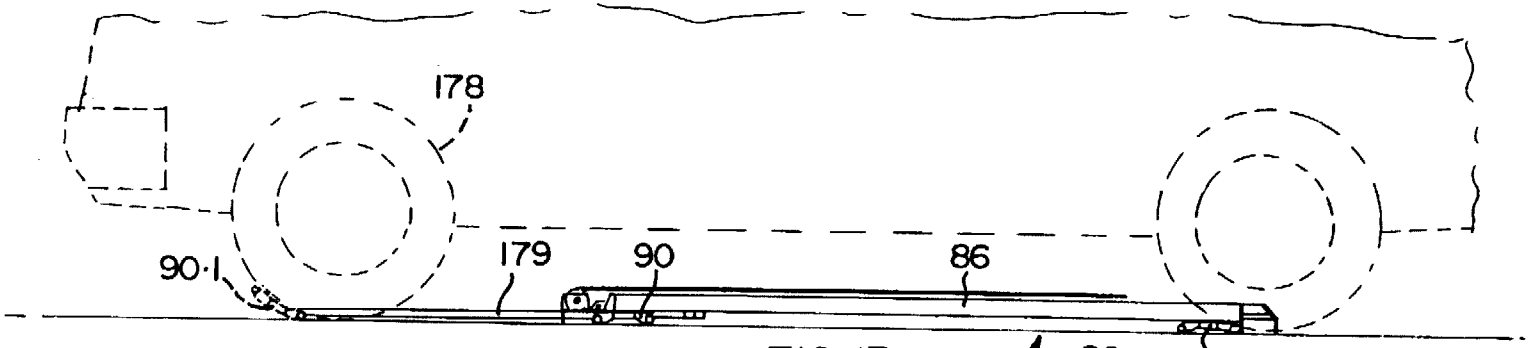
FIG. 13 shows a side view of the base of the storage structure.

Referring now to FIGS. 8 to 13 of the drawings, a development of the collapsible storage structure is designated generally by the reference numeral 80. The collapsible structure 80 is intended for storing a motor vehicle 82 and includes a transport mechanism 84. The structure 80 includes a pair of spaced longitudinally extending guide rails 86, each of which supports a carriage 88 of the transport mechanism 84 slidably thereon. The guide rails 86 are connected together via a pair of transverse cross members 90 (both of which are shown in FIG. 13 of the drawings). The carriages 88 support a plurality of canopy supports 92, 94 thereon. The canopy supports 92, 94 support a canopy 96 of the storage structure 80. It is to be noted in FIGS. 8A to 8C of the drawings that the canopy supports 94 are larger than the canopy supports 92 and, also, extend further than the canopy supports 92. Art end member 98 is supported at a front end of the storage structure 80 and supports the canopy in a neat condition when the canopy 80 is in its unfolded configuration as shown FIG. 8A of the drawings. The canopy supports 92, 94 are so arranged that the supports 94 lie outside the end member 98 with the supports 92 being received within the end member 98 and the canopy 96 being alternately folded over the member 98.

Each carriage 88 comprises a trolley 100 which is slidable along the rails 86 via runners 102 received in a channel 104 of the rails 86.

One of the carriages 88.1 (FIG. 9) carries an operating mechanism 106. The operating mechanism 106 comprises an operating lever 108 which is mounted rotatably fast on a shaft 110 extending through the trolley 100.

Figure 10A:
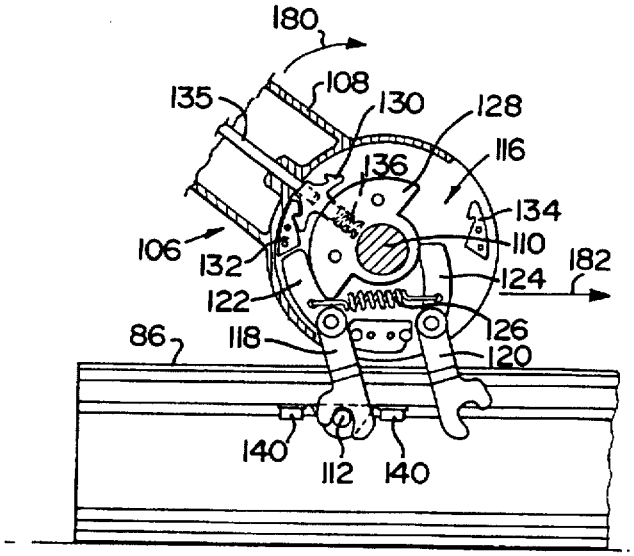
FIGS. 10A to 10C show schematic sectional side views of part of an operating mechanism of the transport mechanism in various positions.
Figure 10B:
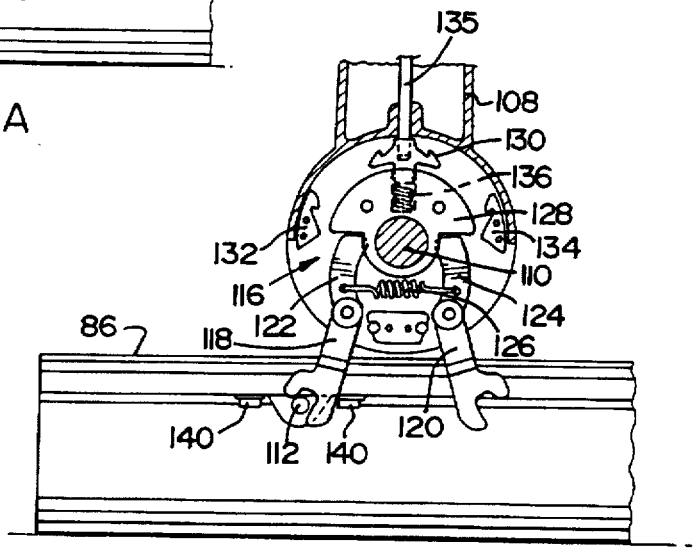
Figure 10C:
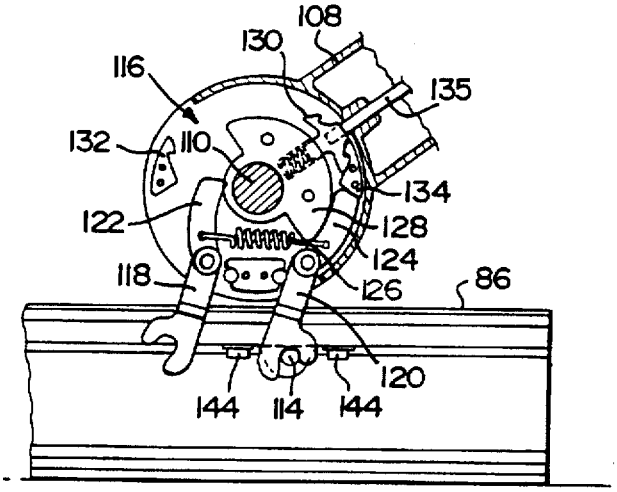

The operating lever 108 is pivotal between the position shown in FIG. 10A of the drawings, through the position shown in FIG. 10B of the drawings to the position shown in FIG. 10C of the drawings. The operating lever 108 adopts the position shown in FIG. 10A of the drawings when the carriages 88 are at the front of the rails 86 (i.e. the position shown in FIGS. 8A and 8B of the drawings) and it adopts the position shown in FIG. 10C of the drawings when the carriages 88 are at the rear of the rails 86 (i.e. the position shown in FIG. 8C of the drawings).

A first locking pin 112 (FIGS. 10A and 10B) is arranged at the front of the rail 86 on which the carriage 88.1 runs and a second locking pin 114 is arranged at the rear of the rail 86 on which the carriage 88.1 runs. The operating mechanism 106 includes a locking mechanism 116 for locking the lever 108 in the positions shown in FIGS. 10A and 10C of the drawings. Hence, the locking arrangement 116 includes a first catch 118 for lockably engaging the pin 112, when the lever 108 is in the position shown in FIG. 10A of the drawings, and a second catch 120 which lockably engages the second pin 114, when the lever 118 is in the position shown in FIG. 10C of the drawings. The catches 118 and 120 are mounted on arms 122 and 124, respectively. The arms 122 and 124 are interconnected via a coil spring 126 which tends to draw the arms 122 and 124 towards each other. The arms 122 and 124 co-operate with a lobed element 128 of the operating mechanism 106 to hold the lever 108 in the vertical position (as shown in FIG. 10B of the drawings) as the carriages 88 are moved from the front of the rails 86 to the rear of the rails and prior to the catch 118 engaging the pin 112 or the catch 120 engaging the pin 114, as the case may be.

The locking arrangement 116 further includes a latch 130 which engages a first catch 132 releasably when the lever 108 is in the position shown in FIG. 10A of the drawings, i.e. when the carriages 88 are at the front of the rails 86 and which engages a second catch 134 when the lever 108 is in the position shown in FIG. 10C of the drawings, i.e. when the carriages 88 are at the rear of the rails 86.

The latch 130 is biased into engagement with the relevant catch 132 or 134 via a coil spring 136 carried in the lobed formation 128. To release the latch 130 from the catch 132 or 134, an operating rod 135 projects through the lever 108.

It is to be noted that the pin 112 is carried on a support pin (not shown) received in a channel 138 of the guide rail 86. The position of the support pin is adjustable along the length of the rail 86 and is locked in position via nuts 140. The pin 114 is also carried on a support pin 142 (FIG. 9) in the channel 138 and the position of the support pin 142 is also adjustable to be locked in position via nuts 144.

Insofar as the carriage 88.2 is concerned, it is to be noted that it does not include an operating mechanism and, hence, no operating lever is provided.

Figure 9:
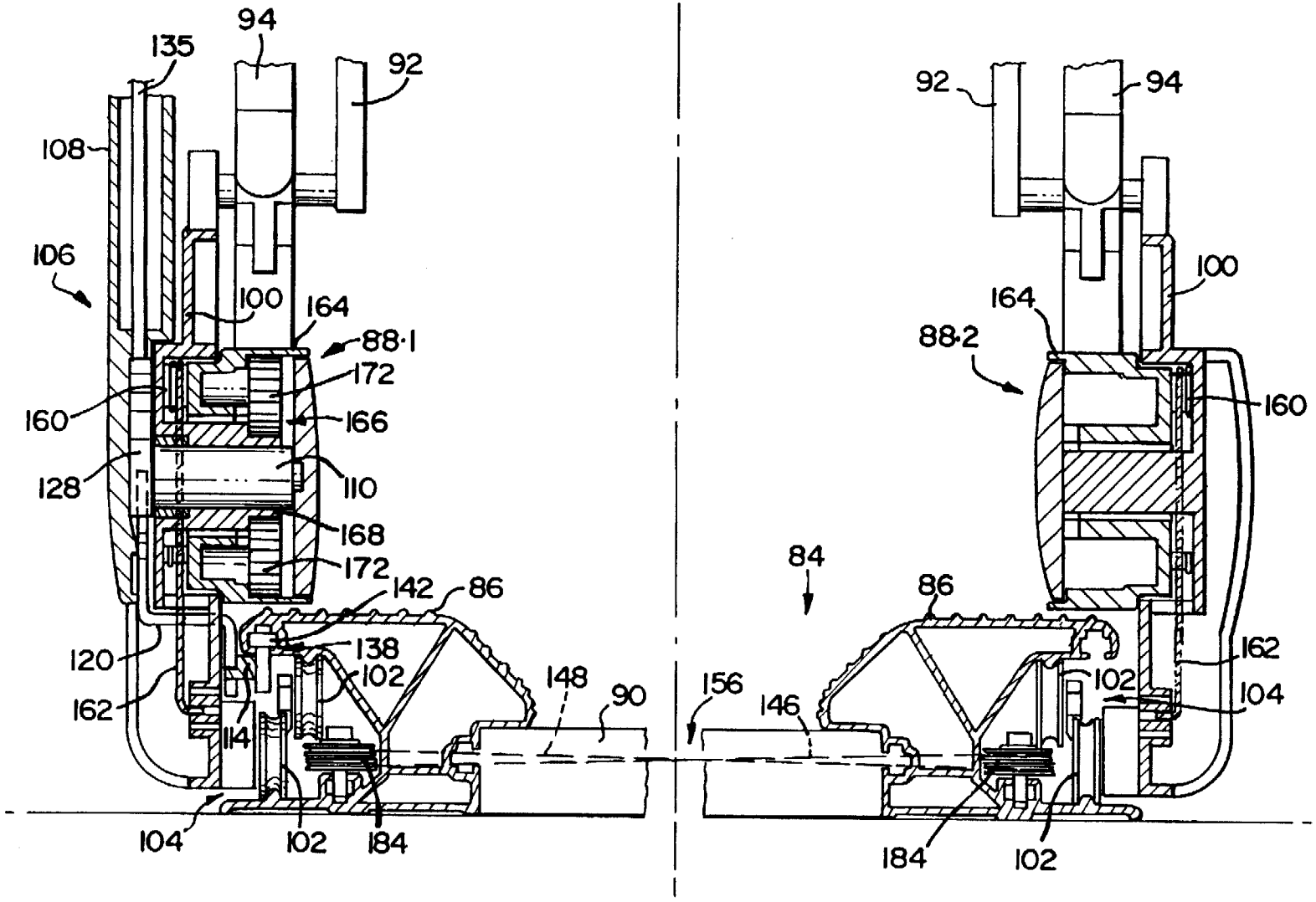
FIG. 9 shows a sectional end view of a transport mechanism of the structure of FIG. 8.

To ensure parallel motion of the carriages 88.1 and 88.2, the carriages 88.1 and 88.2 are interconnected via two lengths of cable 146 and 148. As shown in FIGS. 12A to 12C of the drawings, the cable 148 extends about a pulley 150 and is anchored at 152 on the trolley 100 of the carriage 88.1. The cable 146 is anchored via a slide 154 at a lower region of the trolley 100. Conversely, the cable 146 is wound about a corresponding pulley 150 associated with the carriage 88.2 and is anchored at the position 152 of the trolley 100 of the carriage 88.2. The cable 148 then is carried on the slide 154 of the trolley 100 of the carriage 88.2. Thus, as illustrated in FIG. 9 of the drawings, the cables 146 and 148 cross in the rear cross member 90 as illustrated at 156.

The operating mechanism 106 further includes an urging means 158 (FIGS. 11A to 11C) for urging the operating lever 108 to the position shown in FIG. 10B of the drawings. The urging means 158 comprises a cam 160 mounted rotatably fast with the shaft 110. A biasing means in the form of a coil spring 162 has a first end connected to the cam 160 with an opposed end anchored to the trolley 100.

Figure 11A:
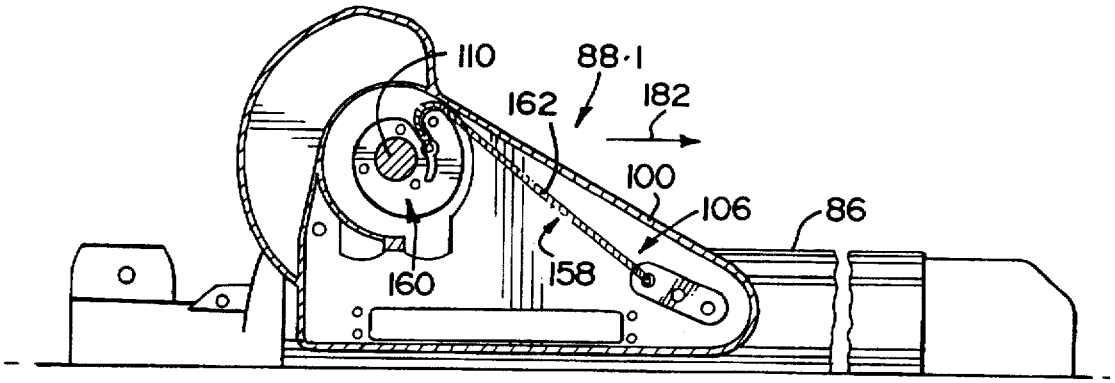
FIGS. 11A to 11C show schematic sectional side views of a trolley of the transport mechanism in various positions.
Figure 11B:
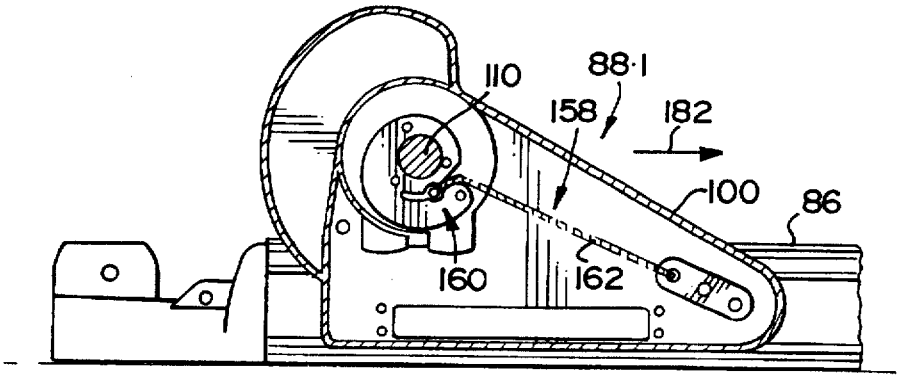
Figure 11C:
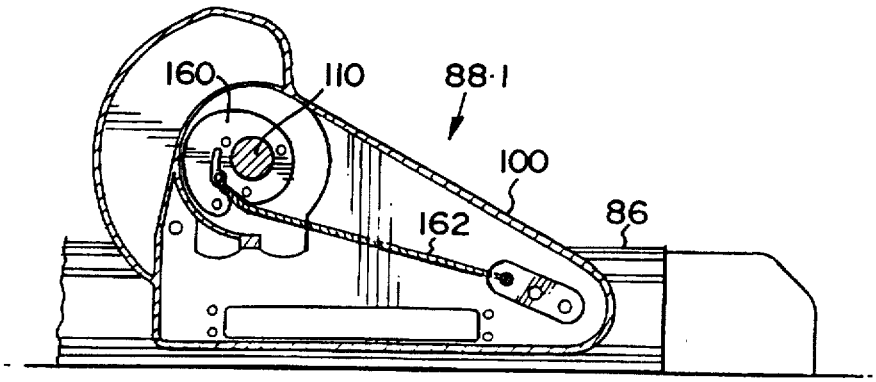

When the operating lever 108 is in the position shown in FIG. 10A of the drawings, the cam 160 is in the position shown in FIG. 11A of the drawings and the spring 162 is under tension. When the lever 108 is in the position shown in FIG. 10B of the drawings, the cam 160 is in the position shown in FIG. 11B of the drawings and the spring 162 is in a relaxed condition. When the lever 108 is in the position shown in FIG. 10C of the drawings, the cam 160 is in the position shown in FIG. 11C of the drawings and, once again, the spring 162 is under tension. Hence, the urging means 158 facilitates pivoting movement of the lever 108 and erection and folding of the canopy 96 of the storage structure 80. It is to be noted that a similar cam 160 and spring 162 is provided on the carriage 88.2.

Certain of the canopy supports 92, 94 are carried on the carriages 88 while other canopy supports 92, 94 are fixed to the rails 86 at the front of the rails 86. Still further, a central canopy support 94.1 (FIG. 8C) runs along the rails 86 on its own runner (not shown). This canopy support 94.1 is held in the position shown in FIG. 8C of the drawings by the tension in the canopy 96.

Those canopy supports 92, 94 carried on the carriages 88 are carried via a carrier 164. The operating lever 108 rotates the carrier 164 via a gearing arrangement 166. The gearing arrangement 166 is a planetary gear arrangement and includes a sun gear 168 arranged rotatably fast with the shaft 110. An internal surface of the carrier 164 has gear teeth 170 thereon with which planetary gears 172 mesh, the planetary gears 172 also meshing with the sun gear 168. The seating arrangement 166 has a gear ratio of approximately 1:1.6 so that, for every degree of arc through the lever 108 is pivoted, the carrier 164 moves through an arc of approximately 1.6 degrees.

Each trolley 100 includes a cam lobe formation 174 at an upstream end thereof. Those carriage supports 92, 94 arranged on the carriers 164 include a follower 176 which runs on the cam lobe formation 174 to facilitate erection or collapsing of the canopy 96 of the storage structure 80 as the carriages 88 move along the rails 86.

Referring now to FIG. 13 of the drawings it is to be noted that the cross member 90 of the storage structure 80 arranged at the front of the rails 86 can, if desired, be removed and inverted, as shown in dotted lines at 90.1 to serve as a stop member for a front wheel 178 of the vehicle. The inverted member 90.1 is mounted on slides 179 which are adjustably mounted on the rails 86.

Figure 8A:
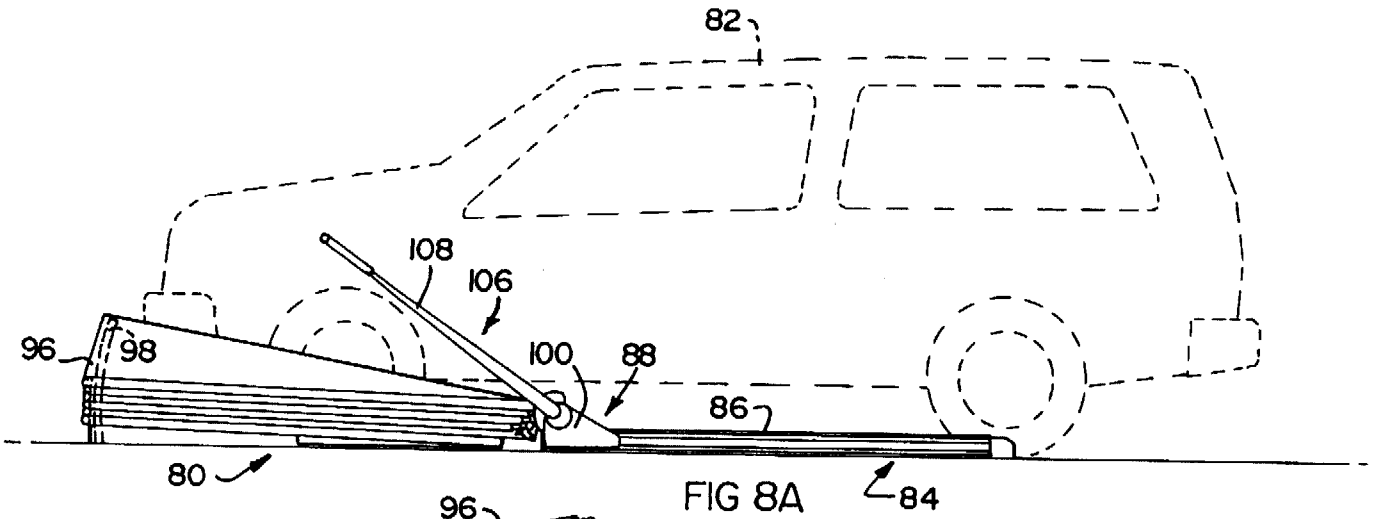
FIGS. 8A to 8C show schematic side views of a collapsible storage structure, in accordance with a development of the invention, in various stages of erection.

In use, the canopy 96 of the storage structure 80 is in its folded or collapsed configuration as shown in FIG. 8A of the drawings. The lever 108 is in the position shown in FIG. 10A of the drawings and the trolleys 100 of the carriages 88 are at the front of the rails 86. The lever 108 is locked in position via the catch 118 engaging the pin 112. Hence, the carriages 88 cannot move on the rails 86. The vehicle 82 is driven into position between the rails 86 as shown in FIGS. 8A to 8C of the drawings.

To extend the canopy 96, the operating rod 135 is depressed so that the latch 130 is released from the catch 132. The lever 108 is rotated in the direction of arrow 180 (FIG. 10A) so that it adopts the position shown in FIG. 10B of the drawings. As shown, when the lever 108 is raised to the vertical position, the catch 118 releases the pin 112. At the same time, the arms 122 and 124 are drawn towards each other via the coil spring 126 and lock in position beneath the lobed formation 128. The carriages 88 are then free to run along the rails 86 in the direction of arrow 182.

Figure 8B:
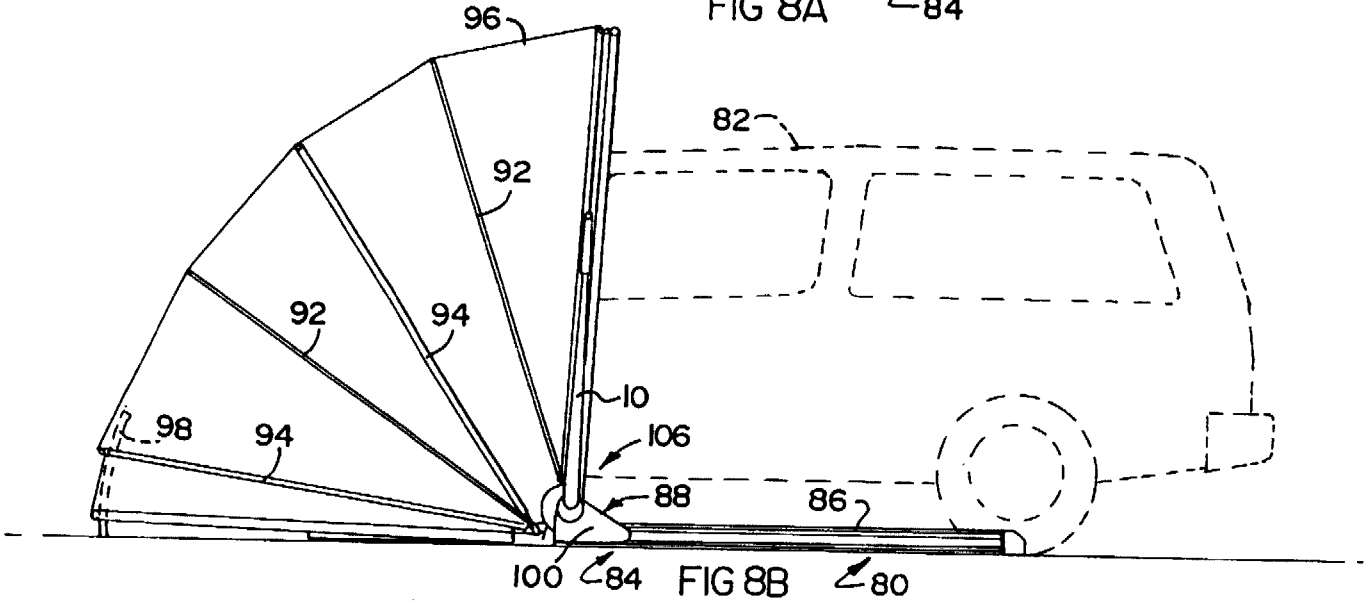
Figure 8C:
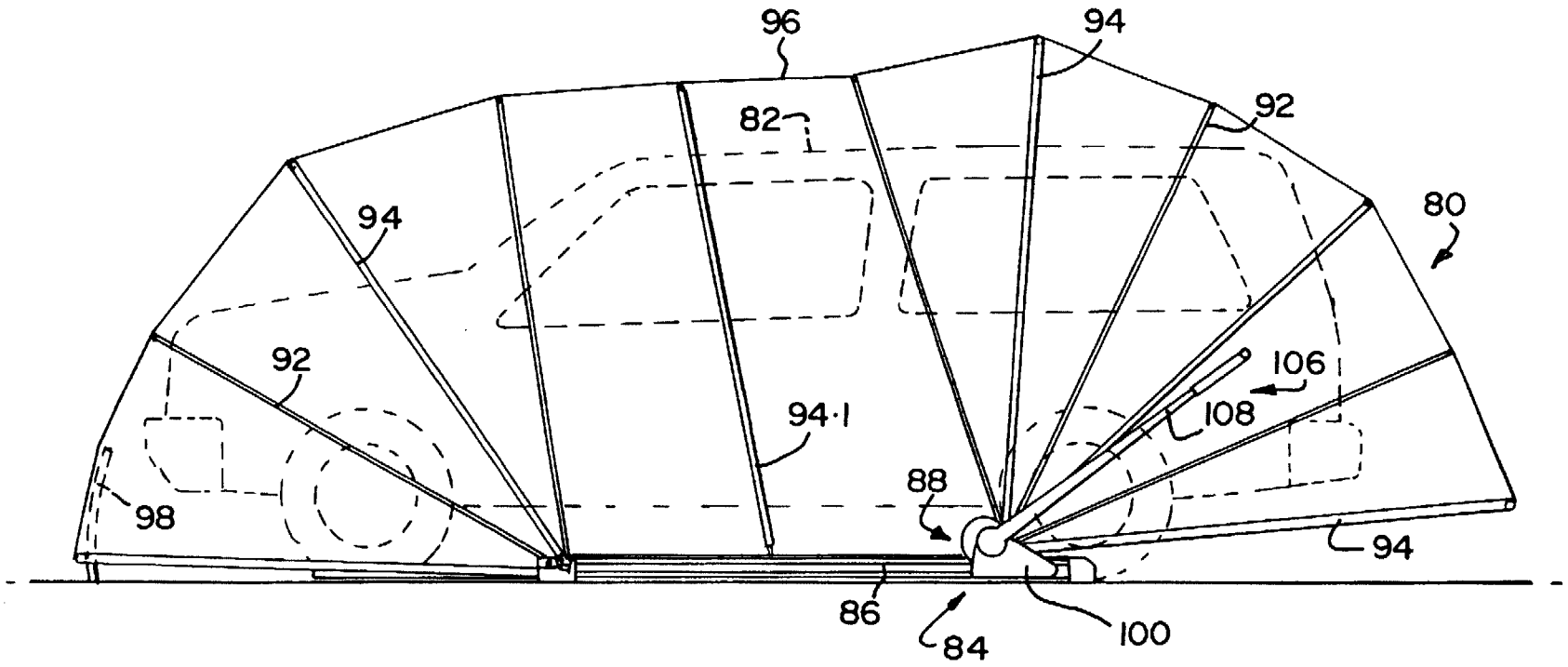

At the same time as the lever 108 is rotated in the direction of arrow 180, the gearing arrangement 166 causes the carrier 164 to rotate in the same direction thereby raising the canopy supports 92, 94 to the position shown in FIG. 8B of the drawings.

Thereafter, the carriages 88 are drawn in the direction of arrow 182 using the lever 108 to guide the carriages 88. The cables 146, 148 ensure parallel motion of the carriages 88 relative to each other is retained. For this purpose it is to be noted that the cables 146, 148 are guided by pulleys 184 arranged at the rear of the rails 86.

At the rear of the rails 86, the catch 120 engages the pin 114. By drawing further on the lever 108 in the direction of arrow 182, the catch 120 pivots, kicking the arm 124 out from under the lobed formation 128 so that the lever 108 can then be pivoted to the position shown in FIG. 10C of the drawings. When the lever 108 reaches this position, the latch 130 engages the catch 134 and the catch 120 is locked in position on the pin 114 so that the carriages 88 are inhibited from being drawn along the rails 86 in the direction opposite to that of arrow 182. When the lever 108 is in the position shown in FIG. 10C of the drawings, the canopy 96 of the storage structure is fully erected and is in the position shown in FIG. 8C of the drawings.

The operating rod 135 of the lever 108 can be locked when the lever 108 is in either of the positions shown in FIGS. 10A or 10C of the drawings by a suitable lock (not shown) to inhibit unauthorized operation of the lever 108.

It is a particular advantage of this embodiment of the invention that a transport mechanism 84 is provided which facilitates erection and collapsing of the canopy 96 of the storage structure 80. In particular, the gearing arrangement 166 and the use of the urging means 158 assists in manipulating the canopy 96 so that the canopy 96 can be erected or collapsed without undue force.

We claim:

1. A collapsible storage structure for the storage of an object, the structure comprising:

a base having front and rear ends and on or over which the object can be placed, the base comprising a pair of longitudinally extending, spaced, parallel rails;

a plurality of inverted, substantially U-shaped canopy supports spanning the base from one rail to the other and being mounted so as to be foldable with respect to the base;

a canopy carried on the canopy supports to be supported over the object, the arrangement being such that, when the canopy supports are in a collapsed configuration, the object can be positioned with respect to the base, whereafter the canopy supports can be displaced to an erected configuration in which the canopy covers the object;

a transport mechanism comprising a pair of carriages, one carriage being slidably arranged on each rail, the carriages carrying at least certain of the canopy supports and the carriages being displaceable between a first position in which the canopy supports are in their collapsed configuration, an intermediate position in which said at least certain of the canopy supports are held together in a substantially upright configuration, and a second position in which the canopy supports are in their erected configuration; and a locking arrangement associated with said at least certain of the canopy supports and at least one of the carriages for locking said at least certain of the canopy supports in their substantially upright configuration while the carriages traverse the rails between their first position and their second position.

2. The structure as claimed in claim 1 in which, to inhibit skewing of the carriages with respect to each other, the carriages are interconnected via suitable flexible elements.

3. The structure as claimed in claim 2 in which the flexible elements are lengths of cable which interconnect the carriages in a predetermined configuration to provide parallel motion of the carriages.

4. The structure as claimed in claim 1 in which one of said at least certain of the canopy supports comprises a substantially U-shaped rear end member which is pivotally mounted on the carriages, the rear end member being pivotally displaceable, when the carriages are proximate the front end of the base, from a collapsed configuration in which it lies substantially horizontally at the front end of the base with a bridging part of the end member lying spaced outwardly from the front end of the base to a substantially upright configuration, and the rear end member further being pivotally displaceable, when the carriages are proximate the rear end of the base, from said substantially upright configuration to an unfolded configuration in which the rear end member lies substantially horizontally with the bridging part lying spaced outwardly from the rear end of the base, the locking arrangement including a holding mechanism whereby the rear end member and at least one further canopy support are held releasably against pivotal displacement when in their upright configuration and while the carriages are being displaced between the front end and rear end of the base.

5. The structure as claimed in claim 4 in which the holding mechanism of the locking arrangement comprises, in respect of at least one of the carriages, a pivot arm carried by the rear end member and on which said at least one further canopy support is mounted, the arm having a receiving formation which receives a guide formation carried by said at least one of the carriages, said carriage further having a notch defined therein in which a free end of the arm is received when the rear end member is in its upright configuration.

6. The structure as claimed in claim 1 inclusive in which each carriage comprises a trolley slidably mounted on its associated rail.

7. The structure as claimed in claim 6 which includes an operating mechanism comprising an operating lever pivotally mounted on one of the trolleys.

8. The structure as claimed in claim 7 in which each trolley includes a carrier on which certain of the canopy supports are carried, the carrier being rotatably mounted with respect to the trolley.

9. The structure as claimed in claim 8 in which each trolley includes a cam lobe formation, each carrier having a follower arranged thereon which runs on the cam lobe formation to facilitate erection or collapsing of the canopy as the carriages move along the rails.

10. The structure as claimed in claim 8 in which, in respect of that trolley having the operating lever, the operating lever is connected to its associated carrier via a gearing arrangement.

11. The structure as claimed in claim 10 in which the gearing arrangement has a gearing ratio exceeding 1:1 so that, for each degree of arc through which the operating lever is pivoted, the carrier, in turn, is rotated through an arc exceeding one degree.

12. The structure as claimed in claim 7 inclusive which includes a locking mechanism for locking the carriages in position at least in their second positions.

13. The structure as claimed in claim 12 in which at least that rail carrying the trolley with the operating lever has a locking pin arranged at least at the rear end of the rail which is engaged by a locking formation of the locking mechanism.

14. The structure as claimed in claim 12, in which the locking mechanism includes the locking arrangement which locks the lever and the carrier in a predetermined position relative to the trolley in which said layer and those canopy supports carried on the carrier are in said substantially upright configuration.

15. The structure as claimed in claim 14 in which the locking arrangement comprises a receiving formation defined at a base of the operating lever and a locking means carried on the carriage, the locking means being releasably received in the receiving formation of the lever when the lever is in its substantially upright position for releasably locking the lever in said position.

16. The structure as claimed in claim 7 inclusive in which the operating mechanism includes an urging means which urges the lever to a substantially vertical position.

17. The structure as claimed in claim 16 in which the urging means comprises a cam formation and a biasing means for biasing the cam formation to its rest position in which the operating lever is in its vertical position.

18. The structure as claimed in claim 17 in which the biasing means is in the form of a coil spring which, due to rotation of the cam, is in tension when the lever is in any position other than the vertical.

* * * * *